US005802954A

United States Patent [19]

Ikeda et al.

[11] Patent Number: 5,802,954

[45] Date of Patent: Sep. 8, 1998

[54] RECIPROCATING PISTON COMPRESSOR

[75] Inventors: Hayato Ikeda; Hiromi Michiyuki; Masanobu Yokoi; Yasunori Ueda, all of Kariya; Masato Nakagawa; Manabu Naoi, both of Seki, all of Japan

[73] Assignees: Kabushiki Kaisha Toyoda Jidoshokki Seisakusho, Kariya; Nagoya Screw Mfg. Co., Ltd, Nagoya, both of Japan

[21] Appl. No.: 617,292

[22] Filed: Mar. 18, 1996

[30] Foreign Application Priority Data

Mar. 22, 1995 [JP] Japan ..... 7-063168

[51] Int. Cl.[6] ..... F01B 3/00

[52] U.S. Cl. ..... 92/71; 411/176

[58] Field of Search ..... 91/502; 92/70, 92/71; 74/60; 411/176

[56] References Cited

U.S. PATENT DOCUMENTS

| | | | |
|---|---|---|---|
| 4,701,110 | 10/1987 | Iijima | 92/71 |
| 5,233,913 | 8/1993 | Muirhead | 92/71 |
| 5,433,137 | 7/1995 | Ikeda et al. | 92/71 |
| 5,456,158 | 10/1995 | Ikeda et al. | 92/71 |
| 5,528,976 | 6/1996 | Ikeda et al. | 92/71 |
| 5,596,920 | 1/1997 | Umemura et al. | 92/71 |

FOREIGN PATENT DOCUMENTS 49-151103 12/1974 Japan .

2127787 10/1990 Japan .

OTHER PUBLICATIONS

Dhigley, J. E., *Mechanical Engineering Design*, McGraw–Hill, 1983, p. 380.

Metals Handbook, Ninth Ed. American Society for Metals, 1985, pp. 73, 76.

*Primary Examiner*—F. Daniel Lopez
*Attorney, Agent, or Firm*—Burgess, Ryan and Wayne

[57] ABSTRACT

A reciprocating piston type compressor for compressing refrigerant gas is provided with a main housing which includes a plurality of parallel cylinder bores arranged around the longitudinal axis of the cylinder block. The main housing has first and second cylinder blocks connected to each other by a plurality of bolts, the cylinder blocks including inner clamping faces and abutting faces. A plurality of pistons are slidably provided within the cylinder bores. An axially extending drive shaft is supported by the main housing for rotation through a pair of bearings. A swash plate is mounted on the drive shaft for rotation with the drive shaft. A pair of thrust bearings are provided between the swash plate and the inner clamping faces of the cylinder blocks to clamp and hold the swash plate therebetween. The clamping force on the thrust bearings from the inner clamping faces is controlled so that the clamping force does not exceed a predetermined allowable upper limit when the compressor is assembled.

7 Claims, 6 Drawing Sheets

RECIPROCATING PISTON COMPRESSOR

BACKGROUND OF THE INVENTION

1. Field of the Invention

The invention relates to a reciprocating piston compressor, which is used in, for example, an air conditioning system for an automobile.

2. Description of the Related Art

In the prior art, a double-headed reciprocating piston compressor comprises a pair of cylinder blocks which are connected to each other to provide a main housing. The compressor further comprises front and rear housings which are connected to the front and rear faces of the main housing. The main housing defines a plurality of cylinder bores equally disposed about the axis thereof. Within the cylinder bores, double-headed pistons are provided to slide along the respective bores. An axially extending drive shaft is supported by the main housing for rotation. A swash plate, for reciprocating the double-headed pistons, is mounted on the drive shaft for rotation therewith. The swash plate is further supported by and clamped between the pair of cylinder blocks through a pair of thrust bearings.

The main, front and rear housings of the compressor are connected by a plurality of axially extending bolts. A tolerance of axial tension in the bolts is selected to prevent a relative movement between the housings, and to prevent an excessive clamping force on the thrust bearings. An insufficient tightening of the bolts results in noise and vibration of the compressor during the operation. On the other hand, over tightening of the bolts results in an excessive clamping force on the thrust bearing, which further results in a failure of the thrust bearings as well as in power loss at the thrust bearings.

Thus, the tolerance of the axial tension in the bolts must be selected within an allowable range. In the prior art compressor, the tolerance is selected so as to obtain a sufficient axial tension in the bolts when the bolts are used within their elastic deformation range. However, if a bolt is used within its elastic deformation range, once the bolt is tightened, a slight difference in the rotational position of the bolt about its axis significantly changes the axial tension thereon. Thus, the control of the axial tension in the bolt is quite difficult. A slight difference in the rotational angle of tightening when the fastening process is terminated may cause the power loss or vibration and noise described above.

The invention is directed to solve the prior art problems described above, and to provide a reciprocating piston compressor improved so that the clamping force on the thrust bearings can be easily controlled within a desired tolerance to prevent an increase of power loss, deterioration of the reliability, and generation of vibration and noise.

SUMMARY OF THE INVENTION

In order to solve the problems of the prior art, the invention provides a reciprocating piston type compressor for compressing refrigerant gas. The compressor comprises a main housing with a plurality of parallel cylinder bores arranged around the longitudinal axis of the cylinder block. The main housing comprises first and second cylinder blocks connected to each other by a plurality of bolts. The cylinder blocks includes inner clamping faces and abutting faces. A plurality of pistons are slidably provided within the cylinder bores. An axially extending drive shaft is supported by the main housing for rotation through a pair of bearings. A swash plate is mounted on the drive shaft for rotation with the drive shaft. The swash plate engages the pistons through shoes provided on the pistons. When the drive shaft rotates, the rotation is transformed to reciprocation of the pistons through the movement of the swash plate. A pair of thrust bearings are provided between the swash plate and the inner clamping faces of the cylinder blocks to clamp and hold the swash plate therebetween. The compressor is further provided with means for controlling the clamping force on the thrust bearings from the inner clamping faces so that the clamping force does not exceed a predetermined allowable upper limit when the compressor is assembled. Thus, the clamping force does not exceed a predetermined allowable upper limit if the bolts are over tightened. This makes the control of the tightening of the bolts easy.

According to a feature of the invention, the bolts can deform plastically to limit the axial tension in the bolts whereby the clamping force on the thrust bearings is limited within the predetermined allowable upper limit. Preferably, the bolts include reduced diameter portions of which the dimensions and the material are selected to deform plastically when the bolts are tightened.

According to another feature of the invention, the thrust bearings comprise races which can deform plastically to control the clamping force thereon.

In another feature of the invention, the controlling means comprises a ring member provided between the respective thrust bearings and the inner clamping faces of the cylinder blocks which deform plastically when the bolts are tightened to connect the cylinder blocks. The ring member may be provided between the abutting faces of the cylinder blocks.

BRIEF DESCRIPTION OF THE DRAWINGS

These and other objects and advantages and a further description will now be discussed in connection with the drawings in which.

DESCRIPTION OF THE PREFERRED EMBODIMENTS

With reference to FIGS. 1–5, the first embodiment of the invention will be described.

Figure 1:
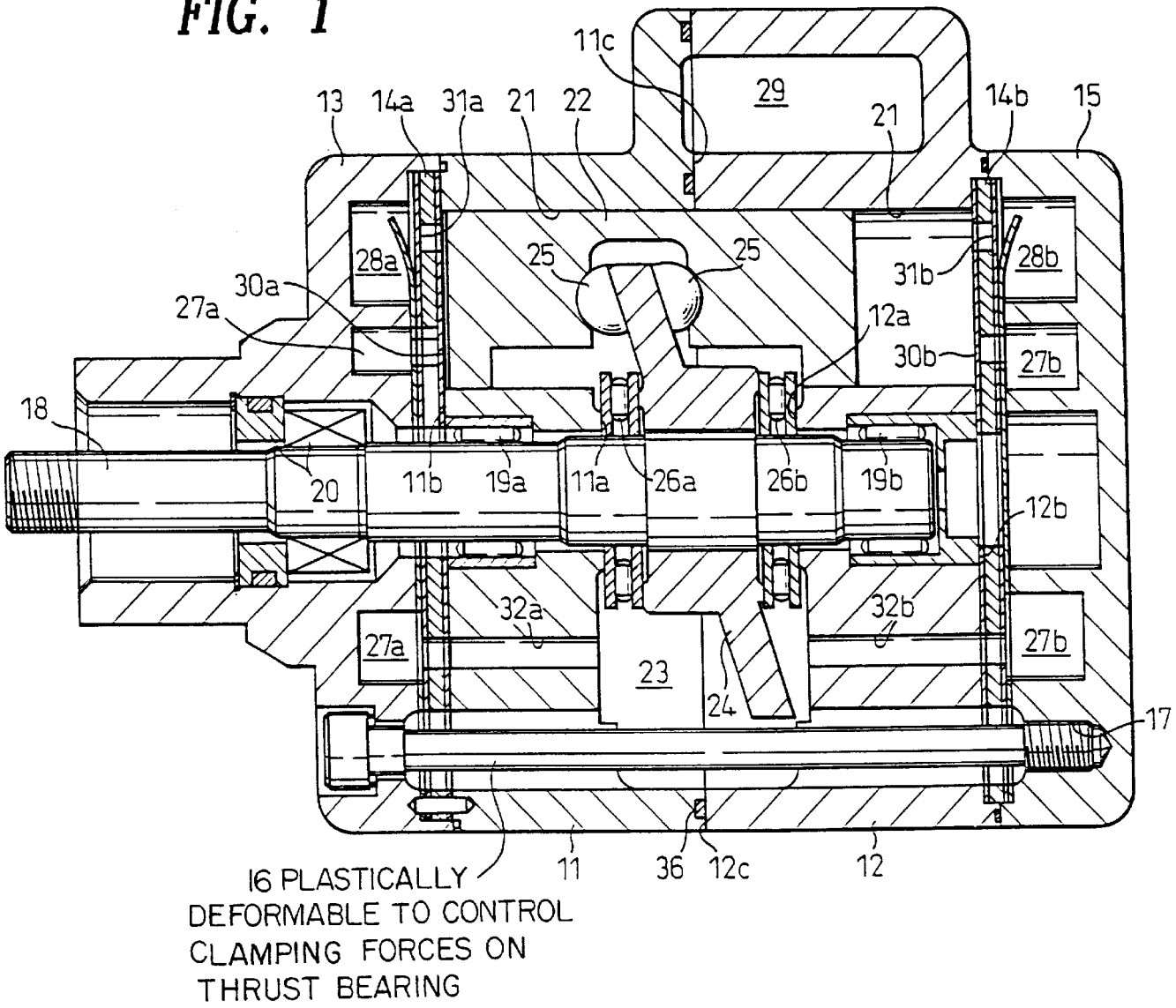
FIG. 1 is a longitudinal section of an example of a compressor to which the invention is applied.

FIG. 1 illustrates a double-headed reciprocating piston compressor to which the invention is applied. The compressor comprises first and second cylinder blocks 11 and 12 which are connected, to provide a main housing, at the ends facing to each other. In particular, the first and second cylinder blocks 11 and 12 include abutting faces 11*c* and 12*c* respectively which contact with each other when the cylinder blocks are connected. A seal ring 36 is clamped between the abutting faces 11*c* and 12*c*. A front housing 13 is connected to a front face 11*b* of the first cylinder block 11 with a valve plate 14*a* clamped therebetween. A rear housing 15 is connected to a rear face 12*b* of the second cylinder block 12 with a valve plate 14*b* clamped therebetween. The front, main and rear housings 13, 11, 12 and 15 are connected by a plurality of axially extending bolts 16 which engage a female threaded sockets 17 provided in the rear housing 15.

A drive shaft 18 extends through the front and main housings 13, 11 and 12, and is supported by the main housing 11 and 12 for rotation through a pair of radial bearings 19*a* and 19*b*. A sealing arrangement 20 is provided between the drive shaft 18 and front housing 13. The drive shaft 18 is operatively connected to a drive source, such as automobile engine (not shown).

The main housing 11 and 12 defines a plurality of axially extending cylinder bores 21 equally arranged about the axis of the main housing. Within the cylinder bores 21, double-headed pistons 22 are provided and are slidable along the respective cylinder bores 21.

The main housing 11 and 12 further defines a swash plate chamber 23 within which a swash plate 24 cooperating with the pistons 22 is mounted to the drive shaft 18. The swash plate 24 is further supported by and clamped between the cylinder blocks 11 and 12 through a pair of thrust bearings 26*a* and 26*b*. The thrust bearings 26*a* and 26*b* are arranged on the inner clamping faces 11*a* and 12*b* of the cylinder blocks 11 and 12 to clamp the swash plate 24 therebetween. The swash plate 24 engages the pistons 22 at its periphery through shoes 25 mounted on the pistons 22. The rotation of the drive shaft 18 is converted into the reciprocation of the pistons 22 through the swash plate 18.

The front and rear housings 13 and 15 define suction chambers 27*a* and 27*b* in the form of rings. The suction chambers 27*a* and 27*b* are connected to an external refrigerant system (not shown) through an inlet port (not shown). The front and rear housings 13 and 15 further define discharge chambers 28*a* and 28*b* in the form of rings. The discharge chambers 28*a* and 28*b* are connected to the external refrigerant system through an discharge muffler 29.

Provided on the valve plates 14*a* and 14*b* are suction valve mechanisms 30*a* and 30*b* through which a refrigerant gas is directed to compression chambers of the respective cylinder bores 21 in which the pistons 22 move toward the bottom dead centers thereof. Further provided on the valve plates 14*a* and 14*b* are discharge valve mechanisms 31*a* and 31*b* through which a compressed refrigerant gas is discharged to the discharge chambers 28*a* and 28*b*.

A plurality of extraction passages 32*a* and 32*b* are provided through the cylinder blocks 11 and 12 to fluidly connect the suction chambers 27*a* and 27*b* to the swash plate chamber 23. The extraction passages 32*a* and 32*b* prevent an increase in pressure within the swash plate chamber 23 by directing the blow-by gas, from the compression chambers to the swash plate chamber 23, to the suction chambers 27*a* and 27*b* through the extraction passages 32*a* and 32*b*.

The compressor is assembled by tightening the bolts 16 to connect the front, main and rear housings to each other as described above. During the tightening of the bolts 16, the axial distance between the inner clamping faces 11*a* and 12*a* of the cylinder blocks 11 and 12 decreases. The amount of the decrease in the axial distance is substantially proportional to the axial tension in the bolts 16. When the bolts 16 are over tightened, the distance between the faces 11*a* and 12*a* decrease beyond the lower limit of the dimensional tolerance. This results in power loss in the thrust bearings 26*a* and 26*b* as well as failure in the thrust bearings. On the other hand, when the tightening of the bolts 16 is insufficient, insufficient clamping force on the thrust bearings 26*a* and 26*b* results in vibration and noise from the bearings. Thus, the axial distance between the inner clamping faces 11*a* and 12*a* of the cylinder blocks 11 and 12, that is, the axial tension in the bolts 16 must be controlled within a desired tolerance.

According to the first embodiment, the bolts 16 can plastically deform to provide a means for controlling the clamping force on the thrust bearings 26*a* and 26*b* so that the clamping force thereon does not exceed a predetermined allowable upper limit, when the compressor is assembled. In other word, in this embodiment, the material and dimensions of the bolts 16 are selected so that the bolts 16 deform plastically when the housings 13, 11, 12 and 15 are connected to each other.

The cylinder blocks 11 and 12 are connected to each other by tightening the bolts 16 with the swash plate 24 clamped between the inner surfaces 11*a* and 12*a* of the cylinder blocks 11 and 12 through the thrust bearings 26*a* and 26*b*. An oil is applied to the threaded portion of each bolt 16 before it is fastened.

Figure 2:
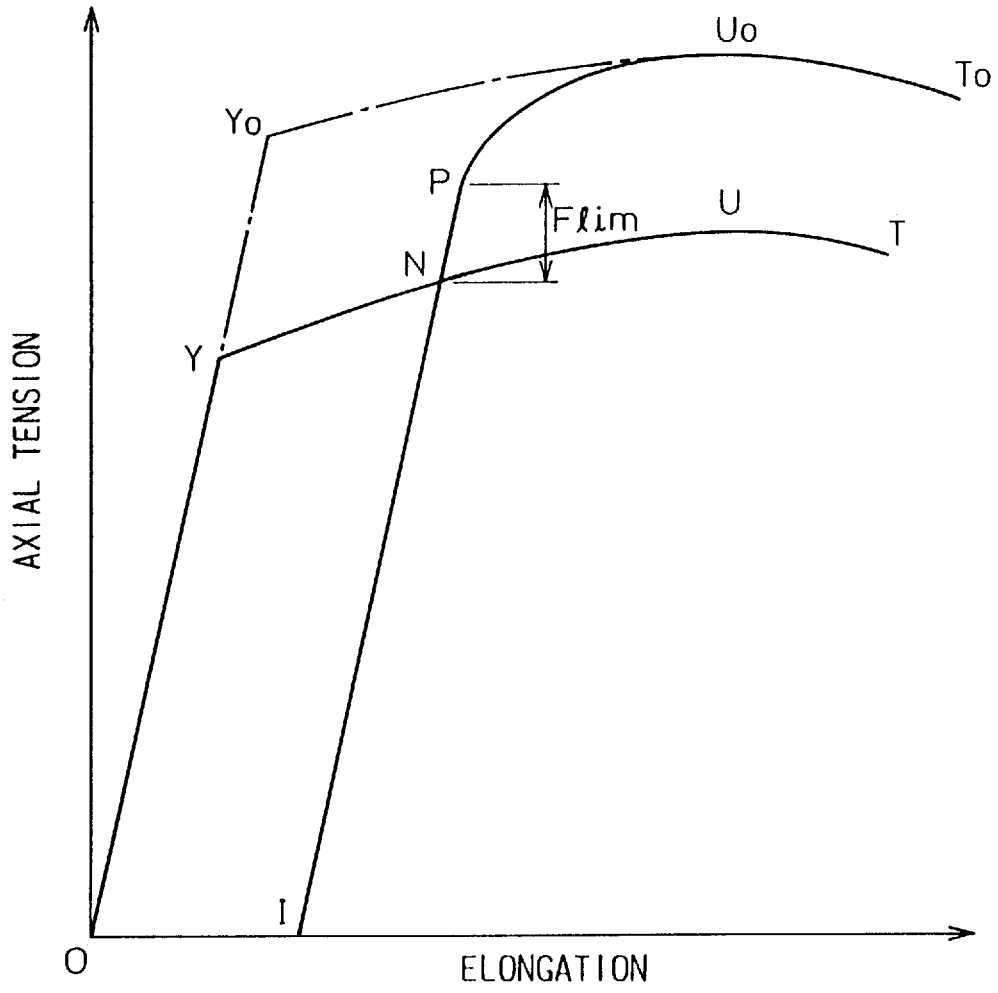
FIG. 2 illustrates a change in an axial tension on a bolt relative to the elongation of the bolt, in which the solid line O-Y-N-U-T shows the change when the bolt is subjected to both axial tension and torsional force, and the broken line $O\text{-}Y_0\text{-}U_0\text{-}T_0$ shows the change when the bolt is subjected to only axial tension.

With reference to FIG. 2, a change in an axial tension on a bolt relative to the elongation of the bolt is illustrated, in which the solid line O-Y-N-U-T shows the change when the bolt is subjected to both axial tension and torsional force, and the broken line O-$Y_0$-$U_0$-$T_0$ shows the change when the bolt is subjected to only axial tension. During a fastening process of a bolt, a torsional stress acts on the bolt as well as an axial stress. Therefore, the bolt will yield at an yielding point "Y" which is lower than a yielding point "$Y_0$" which is the yielding point when the bolt is subjected to only an axial tension. If the bolt is tightened further, the bolt deforms plastically along the line Y-N-U, and is broken at point T.

According to the invention, the fastening process is completed at a point "IN", which is within the plastic deformation range. At the point N, the tightening torque is removed from the bolts 16 to terminate the fastening process. However, a torsional stress remains due to the friction between the bolts 16 and the threaded holes 17 in the rear housing 15. At the point N, the axial tension is lower than the maximum tension at point U. When an axial force is applied to the tightened bolts 16 under the condition at point N, the bolts 16 elastically deform along the line I-N which is parallel to the line O-Y. At point "P", which is defined by, for example, an intersection of line I-N and a curve defined by von Mises yield criterion under the condition satisfying the point N, the bolts 16 deform plastically, and the torsional stress decreases rapidly so that the axial tension changes asymptotically toward the curve $Y_0$-$U_0$-$T_0$. The bolts 16 will be broken at a point $T_0$. Thus, the bolts 16 which yielded at point N can elastically deform between points N and P. Thus, when a load is applied on the fastening system, the bolts 16 which yielded at point N still have an acceptable axial tension denoted by $F_{lim}$ in FIG. 2, that is, an axial force acting on a bolt which does not result in the plastic deformation of the bolt.

Figure 3:
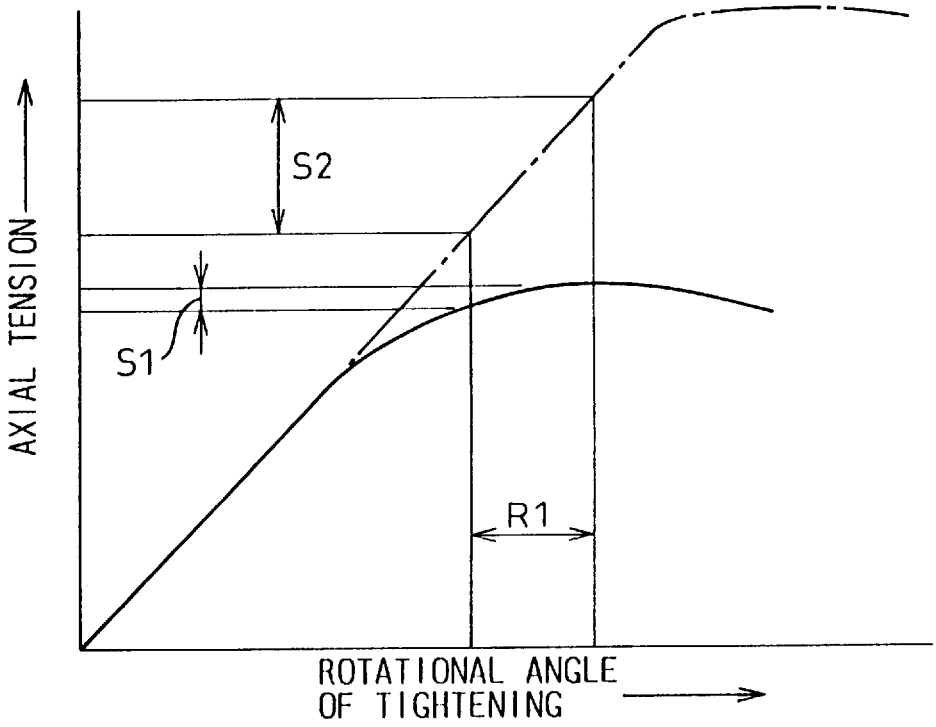
FIG. 3 illustrates an axial tension on a bolt relative to the rotational angle of the bolt tightened.

With reference to FIG. 3, an axial tension on a bolt is illustrated relative to the rotational angle of the tightened bolt. The bolt fastening process is terminated at a rotational angle. However, the rotational angle or the tightening angle at which the fastening process is completed has an error. In FIG. 3, R1 denotes an example of the distribution of the tightening angle of bolts. In FIG. 3, the distribution of the axial tension on a bolt, which is used within the elastic deformation range as in the prior art, is shown by S2 since within an elastic deformation range, the axial tension in the bolt is proportional to the rotational angle of tightening as shown by a broken line. On the other hand, in case of plastic tightening of a bolt, the axial tension on a bolt is not proportional to the elongation of the bolt, that is, the rotational angle of tightening, and the change in the axial tension is relatively small compared to that in case of elastic deformation. The distribution of the axial tension on a bolt which deforms plastically is shown by S1 in FIG. 3. As shown in FIG. 3, the distribution S1 for plastic tightening, is smaller than the distribution S2 for elastic tightening. Thus, in the invention, the bolts 16 are tightened within the plastic range to minimize the distribution of the axial tension in the bolts 16, whereby the housings of the compressor are connected under a desired axial clamping force.

Figure 4:
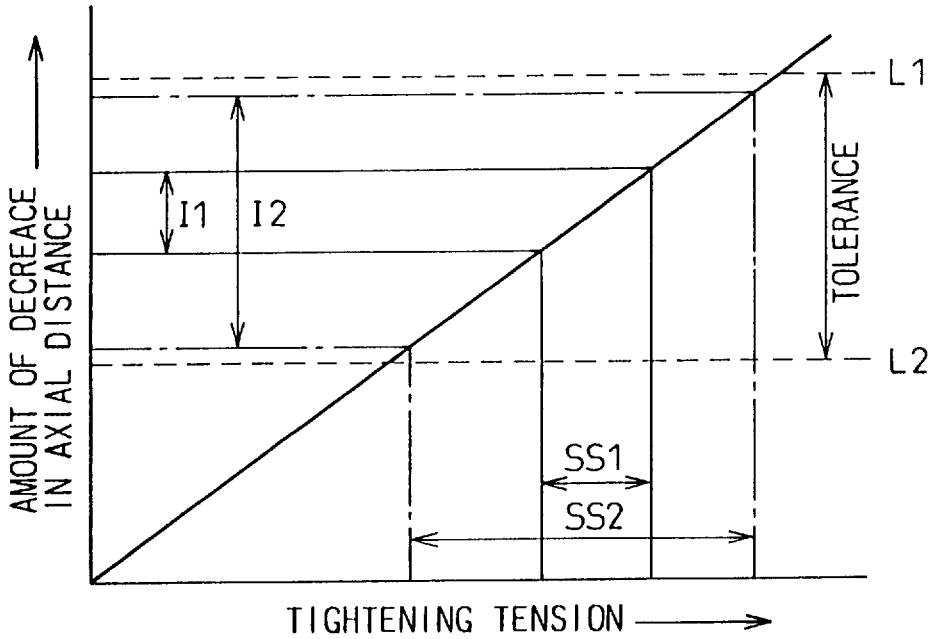
FIG. 4 illustrates the amount of decrease in the distance between the inner clamping faces of the cylinder blocks relative to the axial tension in the bolts 16 is illustrated.
Figure 5:
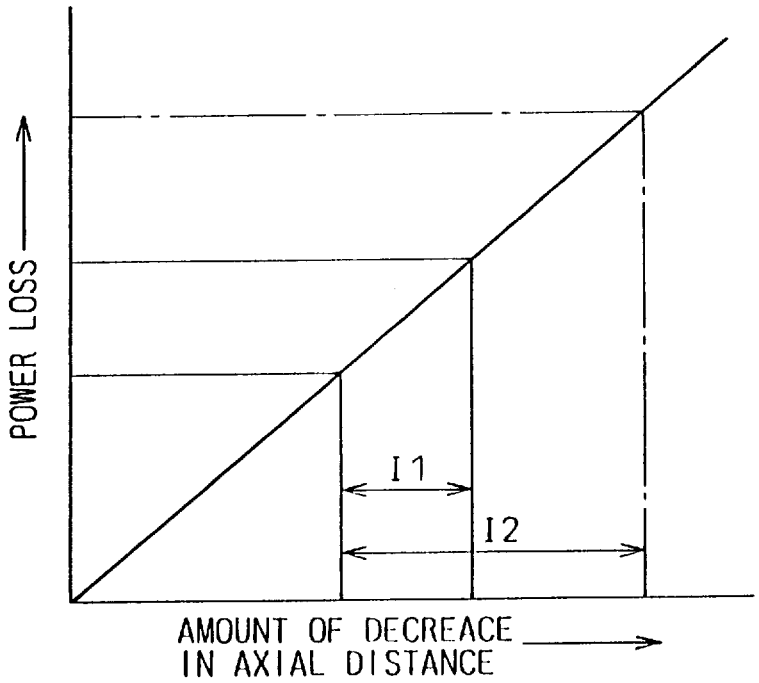
FIG. 5 illustrates the power loss at the thrust bearings relative to the amount of decrease in the distance between the inner clamping faces of the cylinder blocks.

With reference to FIG. 4, the amount of decrease in the distance between the inner clamping faces 11a and 12*a* relative to the axial tension in the bolts 16 is illustrated. As shown in FIG. 4, the amount of decrease in the distance between the inner clamping faces 11*a* and 12*a* is proportional to the axial tension in the bolts 16. Therefore, larger the distribution of the axial tension in the bolts 16, larger the distribution of the amount of the decrease in the distance results. The bolts 16 must be tightened to connect the housings of the compressor within a dimensional tolerance which is shown by upper and lower limits L1 and L2 in FIG. 4. The power loss at the thrust bearings 26*a* and 26*b* is proportional to the decrease in the distance between the inner clamping faces 11*a* and 12*a* as shown in FIG. 5. As will be understood from FIG. 4, when the bolts 16 are used within the plastic deformation range, the distribution of the amount of the decrease in the distance between the inner clamping faces 11*a* and 12*a* is so small that a large margin is obtained compared with the elastic fastening of a bolt. Therefore, according to the embodiment of the invention, in order to optimize the functional operation of the compressor, the design tightening force for the bolts 16 can be reduced toward the lower limit L2 to minimize the power loss at the thrust bearings 26*a* and 26*b*, or it can be increased toward the upper limit L1 to minimize the vibration and noise from the bearings.

Figure 6:
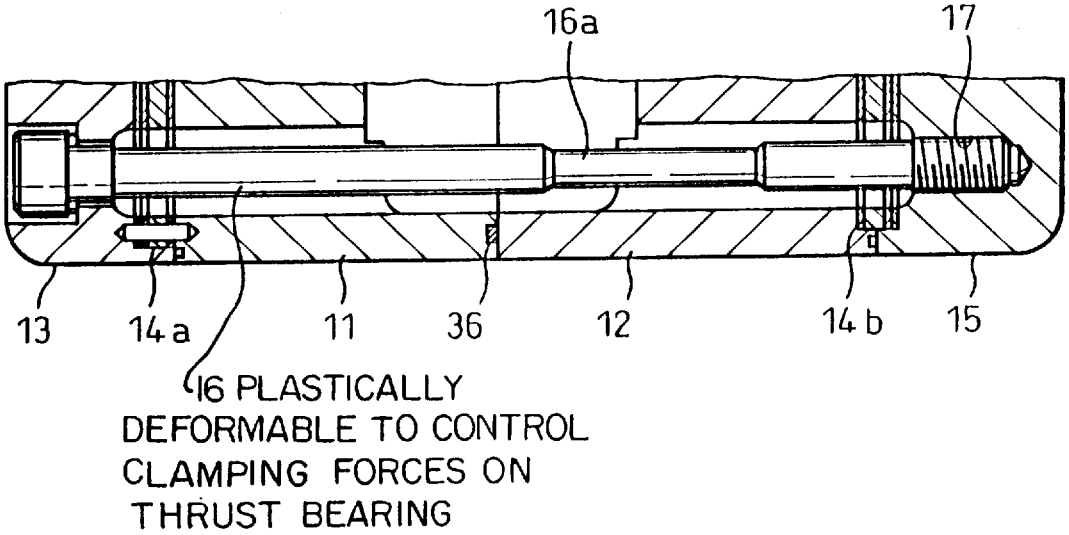
FIG. 6 is a partial section of the compressor of FIG. 1 and illustrates bolts with reduced diameter portions which can deform plastically to control the clamping force on the thrust bearings according to the second embodiment of the invention.

With reference to FIG. 6, the second embodiment of the invention will be described hereinafter.

According to the second embodiment of the invention, each bolt 16 has a reduced diameter portion 16*a* to provide a means for controlling the clamping force on the thrust bearings 26*a* and 26*b* so that the clamping force thereon does not exceed a predetermined allowable upper limit, when the compressor is assembled.

The diameter and material of the reduced diameter portion 16*a* is selected so that the reduced diameter portion 16*a* deforms plastically once the housings 13, 11, 12 and 15 are connected to each other.

In the first and second embodiment, the bolts 16 can be made of a chrome molybdenum steel which has a Rockwell hardness of 30–50 Hr, preferably 35–40 Hr. The bolts 16 are fastened with a fastening torque of, for example, 50 Kg-m, and then further tightened with a tightening angle of, for example, 300 degrees.

Figure 7:
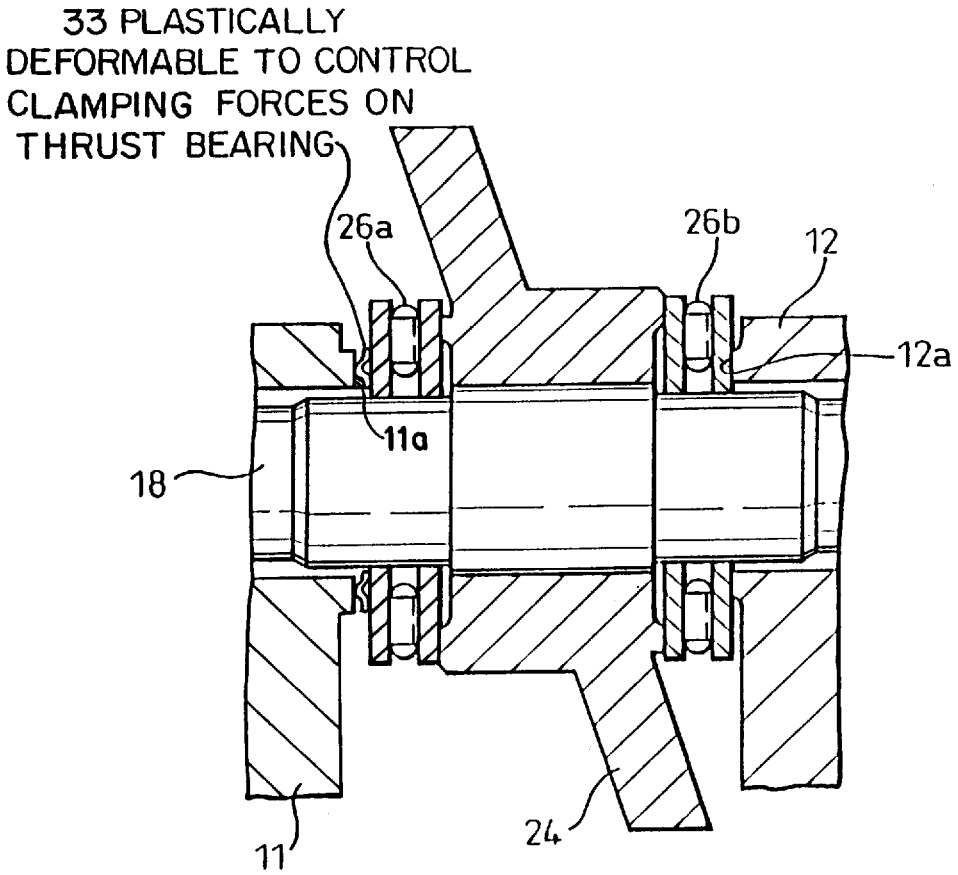
FIG. 7 is a partial section of the compressor of FIG. 1 and illustrates a ring member which is provided between the thrust bearings and the inner clamping faces of the cylinder blocks to control the clamping force on the thrust bearings.

With reference to FIG. 7, the third embodiment of the invention will be described.

The compressor according to the third embodiment further comprises a ring member 33, provided between one of the inner clamping face 11*a* and 12*a* of the cylinder blocks 11 and 12 and one of the thrust bearings 26*a* and 26*b*, which can deform plastically to provide a means for controlling the clamping force on the thrust bearings 26*a* and 26*b* so that the clamping force thereon does not exceed a predetermined allowable upper limit, when the compressor is assembled. In FIG. 7, the ring member 33 is, for example, provided between the inner clamping face 11*a* and thrust bearing 26*a* while the ring member 33 can be provided between the other inner clamping face 12*a* and the other thrust bearing 26*b*.

Figure 8:
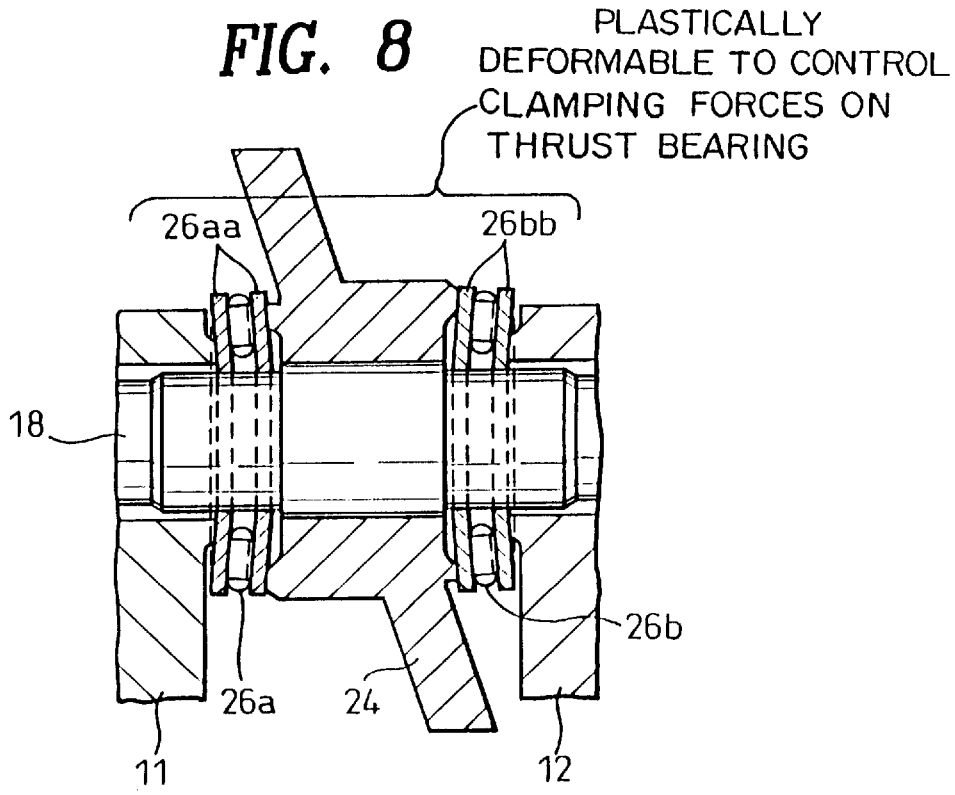
FIG. 8 is a partial section of the compressor of FIG. 1 and illustrates thrust bearings with races which can deform plastically to control the clamping force on the thrust bearings.

With reference to FIG. 8, the fourth embodiment of the invention will be described.

In the compressor according to the fourth embodiment, the thrust bearings 26*a* and 26*b* comprise races 26*aa* and 26*bb* which can deform plastically to provide a means for controlling the clamping force on the thrust bearings 26*a* and 26*b* so that the clamping force thereon does not exceed predetermined allowable upper limit, when the compressor is assembled. In the fourth embodiment, both the bearings 26*a* and 26*b* are provided with the plastically deformable races 26*aa* and 26*bb,* however only one of the thrust bearings 26*a* and 26*b* may be provided with the plastically deformable race. Further, in the fourth embodiment, as shown both the races of the respective thrust bearings 26*a* and 26*b* can deform plastically, however one of the races of the respective thrust bearings can deform plastically.

Figure 9:
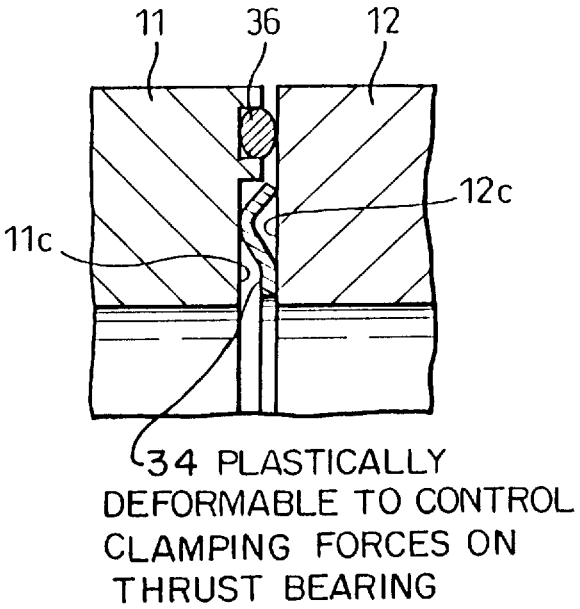
FIG. 9 is a partial section of the compressor of FIG. 1 and illustrates a ring member which is provided between the abutting faces of the cylinder blocks to control the clamping force on the thrust bearings.

With reference to FIG. 9, the fifth embodiment of the invention will be described.

The compressor according to the fifth embodiment comprises a ring member 34, which is provided between abutting faces 11*c* and 12*c* of the cylinder blocks 11 and 12, which can deform plastically to provide a means for controlling the clamping force on the thrust bearings 26*a* and 26*b* so that the clamping force thereon does not exceed a predetermined allowable upper limit, when the compressor is assembled.

Those skilled in the art may understand that the means for controlling the clamping force described above can be applied to the conventional compressor without change or the modification of the basic design of the compressor.

In the embodiments described above, the compressor is a double-headed reciprocating piston compressor as an example. However, the invention can be applied to another type of compressor, such as a single-headed reciprocating piston compressor, a wave plate compressor, and a variable displacement compressor. Furthermore, a plastically deformable member can be provided between the valve plate 14 and the first cylinder block 11 to provide a means for controlling the clamping force on the thrust bearings 26*a* and 16*b*. Yet furthermore, the races of the radial bearings 19*a* and 19*b* can deform plastically.

It may be further understood by those skilled in the art that the forgoing description is a preferred embodiment of the disclosed device and that various changes and modifications may be made without departing from the spirit and scope of the invention.

We claim:

1. A reciprocating piston type compressor for compressing refrigerant gas including:

a main housing with a plurality of parallel cylinder bores arranged around the longitudinal axis of the cylinder block, the main housing comprising first and second cylinder blocks which include inner clamping faces and abutting faces in contact with each other, the first and second cylinder blocks being connected to each other by a plurality of bolts;

a plurality of pistons slidably provided within the cylinder bores:

an axially extending drive shaft supported by the main housing for rotation through a pair of bearings;

a swash plate mounted on the drive shaft for rotation with said drive shaft, and for engagement with the pistons through shoes, the rotation of the drive shaft reciprocating the pistons through the movement of the swash plate;

a pair of thrust bearings provided between the swash plate and the inner clamping faces of the cylinder blocks to clamp the swash plate there between; and at least one means for controlling a clamping force by plastic deformation thereof provided on a path along which a tightening force by the bolts is transmitted to the thrust bearings, on the thrust bearings from the inner clamping faces so that the clamping force does not exceed a predetermined allowable upper limit, when the compressor is assembled wherein the means for controlling the clamping force by plastic deformation is separate from said cylinder blocks.

2. A compressor according to claim 1 in which the bolts have a Rockwell hardness of 30–50 Hr.

3. A compressor according to claim 2 in which the bolts can deform plastically to provide the controlling means.

4. A compressor according to claim 3 in which the bolts include reduced diameter portions which deform when the bolts are tightened.

5. A compressor according to claim 1 in which the thrust bearings comprise races which can deform plastically to provide the controlling means.

6. A compressor according to claim 1 in which the controlling means comprises a ring member provided between the respective thrust bearings and the inner clamping faces of the cylinder blocks, the ring member deforming when the bolts are tightened to connect the cylinder blocks.

7. A compressor according to claim 1 in which the controlling means comprises a ring member provided between the abutting faces of the cylinder blocks, the ring member deforming when the bolts are tightened to connect the cylinder blocks.

* * * * *